US005594418A

United States Patent [19]

Martin

[11] Patent Number: 5,594,418

[45] Date of Patent: Jan. 14, 1997

[54] SELF-CONTAINED DUAL PANEL WINDOW SCREEN ALARM

[76] Inventor: Lyle B. Martin, 1510 Gary St., Bethlehem, Pa. 18018

[21] Appl. No.: 595,181

[22] Filed: Feb. 1, 1996

Related U.S. Application Data

[63] Continuation-in-part of Ser. No. 489,041, Jun. 9, 1995, abandoned.

[51] Int. Cl.[6] ..... G08B 13/08

[52] U.S. Cl. ..... 340/546; 200/61.93; 340/550; 340/693

[58] Field of Search ..... 340/550, 546, 340/545, 693; 200/61.93

[56] References Cited

U.S. PATENT DOCUMENTS

| | | | |
|---|---|---|---|
| 3,051,935 | 8/1962 | Willson | 340/550 |
| 4,495,486 | 1/1985 | White | 340/546 |
| 4,814,750 | 3/1989 | Abramson | 340/550 |
| 4,839,632 | 6/1989 | Zahn, Jr. et al. | 340/550 |
| 5,103,208 | 4/1992 | Riordan | 340/550 |

*Primary Examiner*—Glen Swann
*Attorney, Agent, or Firm*—Sanford J. Piltch

[57] ABSTRACT

An expandable intrusion detection screen for use with an audible electronic alarm has first and second screen panels slidably movable in parallel relation to each other to be expandable to fit within different sized window openings. The alarm is mechanically mounted and retained within an internal peripheral channel in the frame of one of the screen panels and has an intrusion detector extending outward through the frame of the screen panel for detecting the separation of the screen panel from any part of the window against which the detector is placed when positioned in a window opening.

19 Claims, 3 Drawing Sheets

SELF-CONTAINED DUAL PANEL WINDOW SCREEN ALARM

CROSS-REFERENCE TO RELATED APPLICATION

This application is a continuation-in-part of U.S. patent application Ser. No. 08/489,041, filed Jun. 9, 1995, now abandoned.

BACKGROUND OF THE INVENTION

The dual panel window screen alarm of the present invention generally resides in the field of audible alarms for detecting intrusion into a premises. More particularly, the invention pertains to removable window screens to which alarms have been attached.

There have not been any window screen alarms which are removable at will and are totally self-contained. Neither are any such apparatus available for sale at the present time. In researching previously described apparatus useful for providing an alarm at a window opening of a structure where the components of the alarm are mountable to a screen or mesh overlying the window opening, none were found that were removable from one opening and replaceable in another.

One recent attempt in providing a window screen alarm is described in U.S. Pat. No. 4,814,750 (Abramson). This patent describes an alarm system in which the screen is illustrated in two segments which appear to slide vertically relative to each other. The alarm system includes a self-contained, battery powered alarm circuit with an audible alarm means with both the circuit and audible/visual alarm elements mounted separate from the various wires covering the screen. From the written description, it appears that a magnetically responsive switch detects the removal of the screen from the window frame, or a "plug" connection may be broken by the same action of removing the screen from the frame, either causing the alarm circuit to trigger the audible/visual alarm mechanism.

An expandable entry detection apparatus is described in U.S. Pat. No. 5,103,208 (Riordan). The description is exemplary of an expandable alarm screen comprised of two frames which slide relative to each other in a horizontal motion. As in the case of the Abramson patent, the Riordan patent describes a screen which has alarm wires woven onto or through the mesh and connected through a common conductor to a "plug" means for connection to a separate alarm circuit mounted in the structure.

The disclosure in U.S. Pat. No. 3,051,935 (Willson) is similar to both of the patent descriptions discussed above in that a single screen has woven onto or in the mesh a series of alarm wires which are connected to an external alarm circuit set apart from the screen. The Willson patent is slightly different in that it describes a pair of contacts which complete the electrical circuit mounted on the window frame which contact the screen. Thus, removal of the screen, or cutting of any of the wires in the mesh, will trigger the alarm.

Another related apparatus is the intrusion alarm screen described in U.S. Pat. No. 4,839,632 (Zahn, Jr., et al.) which describes a window screen incorporating magnetic reed switches attached to interwoven alarm circuit wires on the mesh to detect removal of the screen from a framework, such as a window frame. The Zahn patent also discloses an alternate use of plug and socket connections for making the screen part of an entire house burglar alarm circuit.

None of these prior patents provide for a screen to which an audible alarm is attached which is entirely free standing (not attached to any structure alarm system) and does not have some form of interwoven alarm wires on or through the screen mesh.

It is, therefore, one object of the present invention to provide a self-contained screen alarm which is expandable to fit different sized window openings with the alarm detection means, control circuit, and audible alarm carried on-board the screen.

It is a further object of the present invention to provide a battery-powered screen alarm which is easily removed from one window opening and transferred to another.

It is a still further object of the present invention to provide an alarm detection means which is responsive to either the removal of the screen alarm from the window opening or the raising of the window without removal of the screen alarm.

Other objects will appear hereinafter.

SUMMARY OF THE INVENTION

The present invention may be described as a portable expandable intrusion detection alarm screen for use with an audible electronic alarm. The combination screen and alarm is comprised of first and second screen panels having brackets which are affixed to both of the screen panels. The brackets are positioned to form respective adjacent parallel channels. The brackets attached to the second panel form an adjacent parallel channel in which the first screen panel is slidably movable in parallel relation to the second screen panel. The brackets attach to the first screen panel form an adjacent parallel channel in which the second screen panel is slidably movable in parallel relation to the first screen panel. With the brackets attached in this manner, each screen panel can slidably move in relation to the other to be expandable to fit within different sized window openings.

Screen mesh is mechanically mounted and retained within an internal peripheral channel in the frame of each of the first and second screen panels. An audible electronic alarm is permanently affixed to a mounting bracket which is attached to one of the screen panels. The alarm includes an intrusion detector which extends outward through the frame of the screen panel to which the alarm is mounted. The intrusion detector is used to facilitate detection of the separation of the screen panel from any part of the window against which the screen panel onto which the alarm is attached is placed when positioned in a window opening.

The alarm is armed and disarmed by a switch which is operable by use of a special key, The key may be a thin, sharp pointed implement.

The intrusion detector can be of a plunger-type actuator capable of detecting the separation of the screen panel from the window part against which the actuator is placed upon the occurrence of the removal of the expandable intrusion detection screen or the raising of the window. The intrusion detector may be mounted through the frame of the screen panel proximate to the alarm or at a pre-determined distance from the alarm. The mounting bracket which attaches the alarm to either of the screen panels is attached by flanges on adjoining sides of the mounting bracket which extend into the internal peripheral channel in the frame of the screen panel and retained in position by both the screen mesh and elastomeric tubular retainer.

The audible electronic alarm system may further comprise a second intrusion detector which has plural contacts which extend through the frame of the screen panel to which the alarm is mounted on the side facing the other screen panel for contact with a conductor strip. The conductor strip is mounted to the adjacent facing side of the frame of the other screen panel for detecting the inward sliding of one screen panel against the other screen panel more than a pre-determined distance. The pre-determined distance may be in the range of one inch to six inches in order to prevent entry into the building structure of all or a portion of an intruder.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
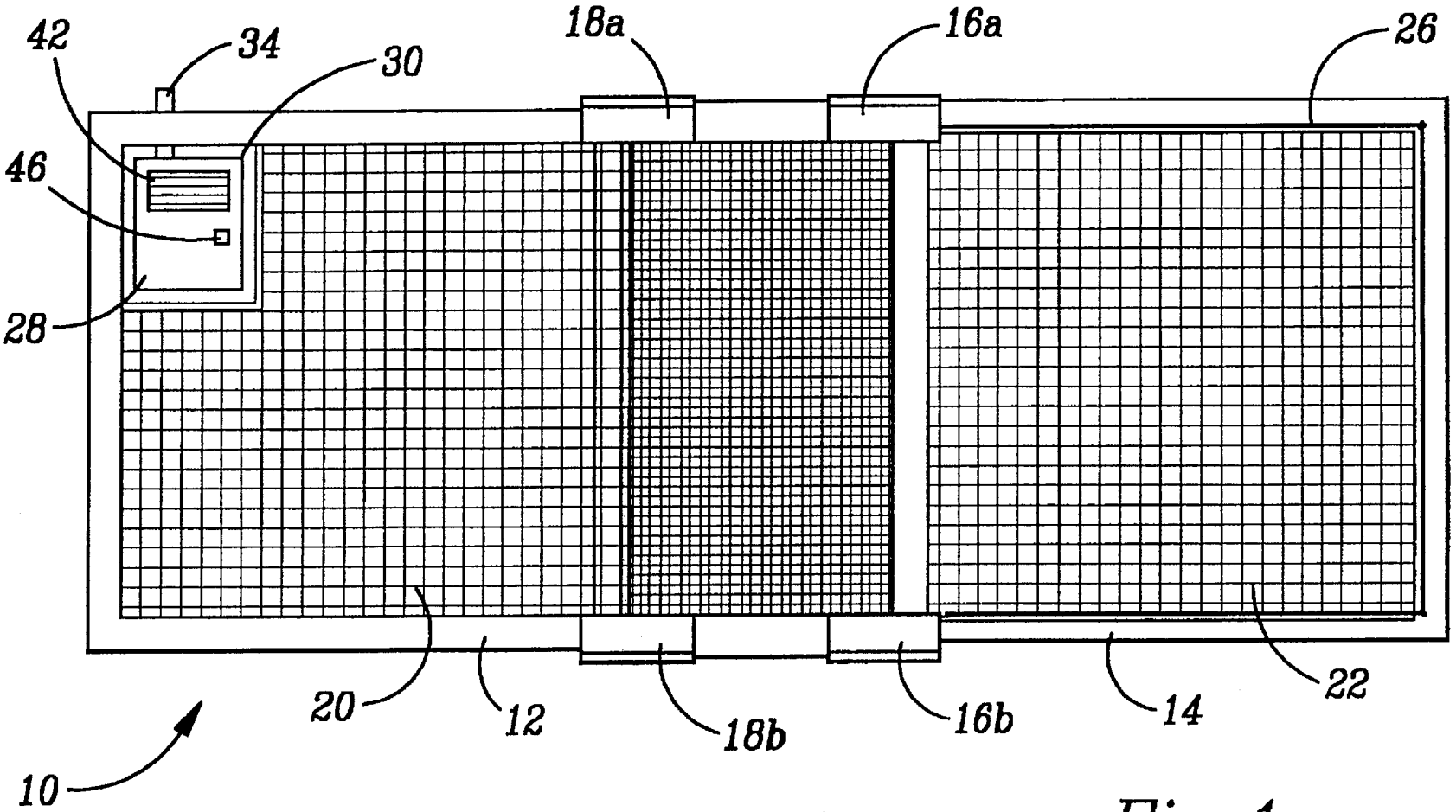
FIG. 1 is a front elevational view of the screen alarm of the present invention showing the overlap of the plural panels of the screen alarm.

Referring now to the drawings in detail, where like numerals refer to like parts or elements, there is shown in FIG. 1 the screen alarm means 10 of the present invention. The screen alarm means 10 is comprised of first and second screen panels 12, 14 which partially overlie one another so that screen panel 12 can slide relative to screen panel 14 in either an inward or outward direction to adjust the overall length of the screen alarm means 10. The screen panels 12, 14 are held in parallel alignment by bracket sets 16*a, b* and 18*a, b* which are attached and operate as follows.

The first bracket set 16*a, b* is fixedly mounted to the first screen panel 12 and establishes a track within which the second screen panel 14 can travel in parallel alignment to the first screen panel 12. Likewise, the second bracket set 18*a, b* is fixedly attached to the second screen panel 14 with the bracket set 18*a, b* providing a track for the travel of the first screen panel 12 in parallel alignment with the second screen panel 14. Each of the bracket sets 16*a, b* and 18*a, b* are respectively mounted at the proximal opposing ends of the first and second screen panels 12, 14 such that the bracket sets 16*a, b* and 18*a, b* restrict or limit the outward expansion or travel of each of the screen panels 12, 14 which will be described in greater detail below.

Figure 3:
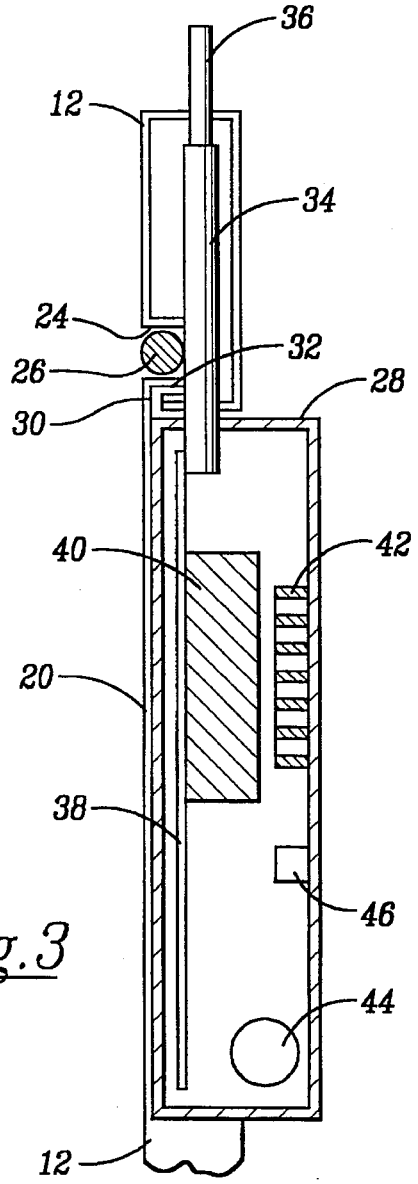
FIG. 3 is a cross-sectional view of the screen alarm of the present invention taken along Line 3—3 of FIG. 2.

Each of the screen panels 12, 14 is rectangular in configuration and has mounted within a peripheral frame screen mesh 20, 22, respectively. In the central portion of FIG. 1, where both screen panels 12, 14 overlie one another, the mesh sizing of the screen mesh appears smaller than that of the screen mesh 20, 22 in order to show that one panel overlies the other. The screen mesh 20, 22 is mounted into the frame of each of the screen panels 12, 14 by mechanically inserting the screen mesh 20, 22 into a groove or channel 24 and held fixedly in position by an elastomeric elongated tubular retainer 26, both of which are continuous about the internal periphery of the frame of both the first and second screen panels 12, 14. See FIG. 3. The retainer 26 is compressed to fit within the channel 24 to securely hold the screen mesh 20, 22 in position within the frame of each of the panels 12, 14.

Figure 2:
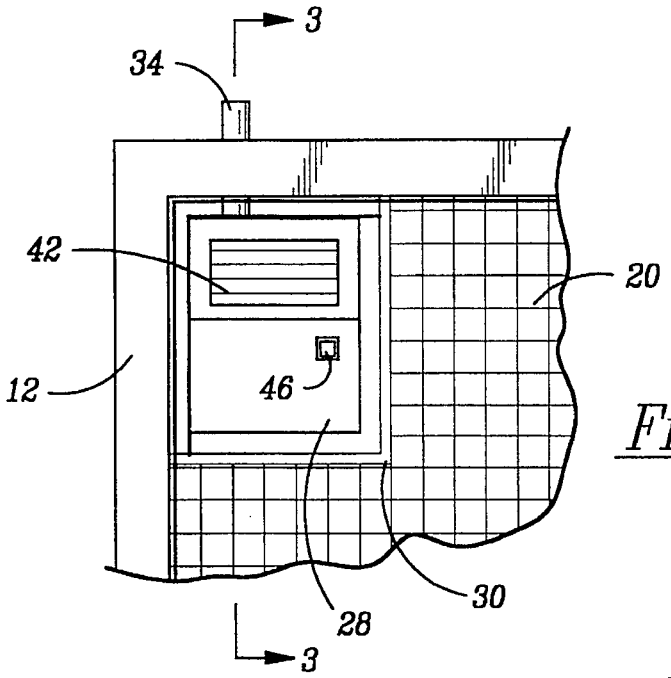
FIG. 2 is an enlarged segment of the upper left region of the front elevational view of FIG. 1.

With reference to FIG. 2, there is shown the alarm box 28 permanently affixed to mounting plate 30. The mounting plate 30 is configured in a substantially flat plane of dimensional size substantially matching the alarm box 28. The mounting plate 30 has, on two adjoining sides, flanges 32 which are bent normal to the flat support plane for the alarm box 28 so that each flange 32 can fit within the channel 24. This enables the mounting plate 30 to be held in position both by the screen mesh 20 and the retainer 26 so that neither the mounting plate 30 nor the alarm box 28 can be moved once properly positioned and the retainer 26 placed within the channel 24. The alarm box 28 is fixedly positioned on the flat mating surface of the mounting plate 30 by use of an epoxy or glue.

As shown in FIG. 2, the alarm box 28 is mounted in the upper left region of the first screen panel 12. This is primarily so for the reason that the alarm detector means 34 is able to extend upward through the frame of the first screen panel 12 to come into contact with a window lowered onto it from above. As can best be seen from FIG. 3, the alarm detector means 34 consists of a plunger 36 which moves in and out of the alarm detector means 34 to make or break a circuit contact. For the sake of simplicity, the alarm box 28 is shown in outline in FIG. 3 with only the major components shown as being housed within the alarm box. These major components are the alarm detector means 34, the circuit board 38, speaker 40, sound baffles (in the alarm box case) 42, and battery 44. The alarm circuit may be any circuit presently known and used in the field in which the plunger 36, when extended upward or outward by the urging of an internal spring within the alarm detector means 34, causes the alarm circuit to be completed which will sound the audible alarm through the speaker 40.

The screen alarm means 10 is armed and disarmed by use of a switch means 46 which may be any presently known or later discovered switch which provides connection between the battery power source and the alarm circuit, but which requires a key means to actuate the switch mechanism. The key means provides the additional security of not easily disarming the screen alarm means 10 when it is armed and actuated by removal from a window opening or the opening of the window as described more fully below. The key means may be the point of any implement, such as a pen or pencil, which is able to fit within the small diameter opening of the switch means 46 exposed through the alarm box 28.

The screen alarm means 10 of the present invention is intended to be positioned within the window opening of a double hung window such that the bottom of the first and second screen panels 12, 14 contact the window sill and the top of the first and second screen panels 12, 14 contact the bottom of, for example, the lower sash of a double hung window. In this manner, the plunger 36 of the alarm detector means 34 will come into contact with the bottom of the lower sash of the double hung window causing the plunger to be depressed inward opening the alarm circuit. With both of the screen panels 12, 14 extended outward to touch the sides of the window opening the screen alarm means 10 acts as a screen or ventilator to permit air flow through the window opening and into a room in a building or structure.

Figure 4:
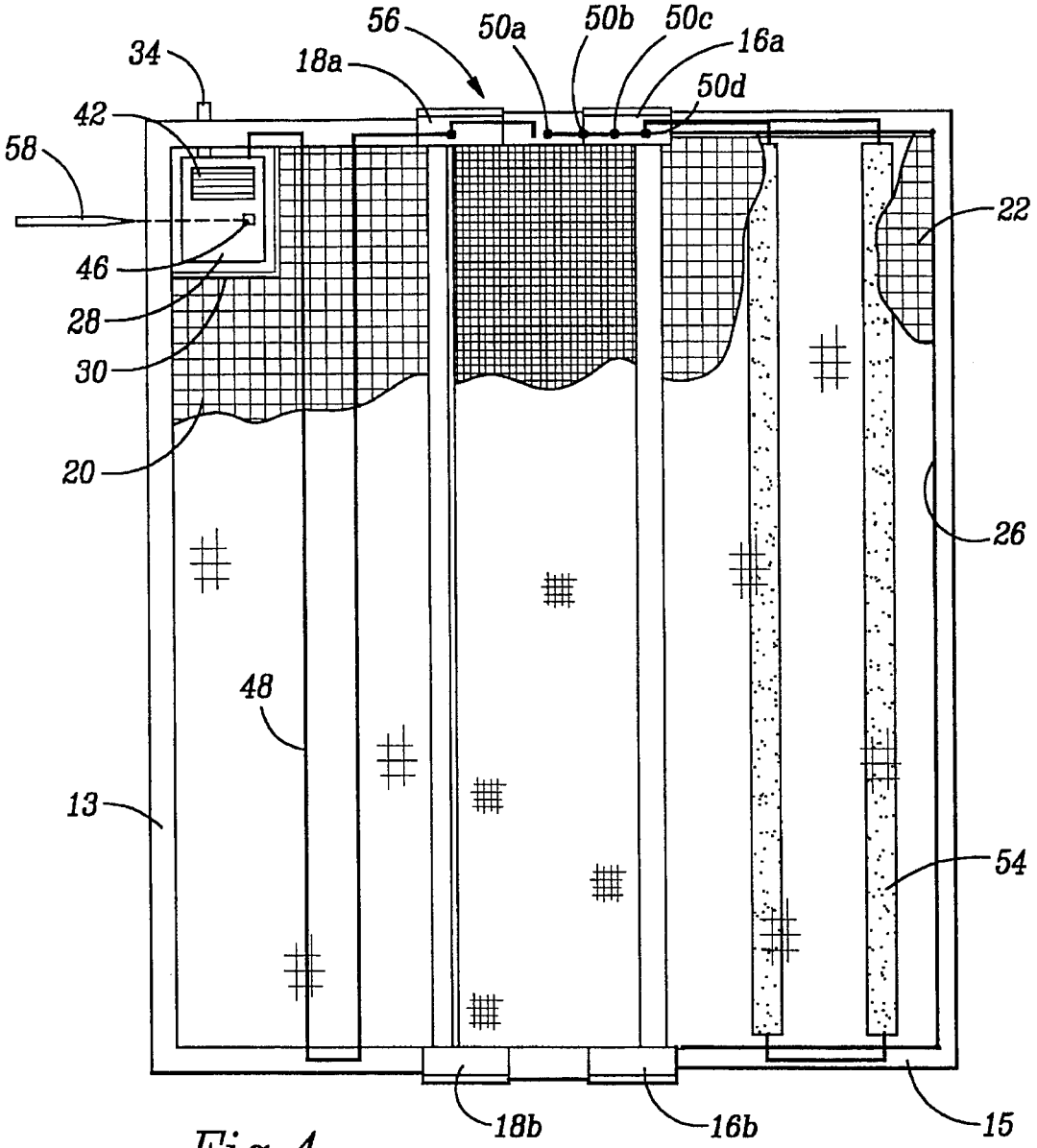
FIG. 4 is a front elevational view of the screen alarm of the present invention showing the second intrusion detector of the screen alarm.

As illustrated in FIG. 4, the screen alarm means 10 can be fit into a variety of differently shaped windows where the window opening height may be equal to or greater than its width. This is accomplished by fixedly mounting bracket set 16*a, b* to the short sides of a rectangular screen panel 15 thus establishing a track within which screen panel 13 can travel. Likewise, as described above, the second bracket set 18*a, b* is fixedly attached to the short sides of rectangular screen panel 13 with bracket set 18*a, b* providing a track for the travel of screen panel 15. As described above, each of the bracket sets 16*a, b* and 18*a, b* are respectively mounted at the proximal opposing ends of the first and second screen panels 13, 15. In this manner, the bracket sets 16*a, b* and 18*a, b* limit the outward expansion or travel of each of the screen panels 13, 15. Once in position, the screen alarm means 10 may be armed utilizing the key means of the switch means 46 to energize the alarm circuit. The alarm circuit remains in a standby state because the plunger 36 of the alarm detector means 34 is depressed so that the alarm circuit is not completed. On the occasion of either opening the window by raising the lower sash or removing the screen alarm means 10 without disarming the device, an alert will sound from the speaker 40 as the plunger 36 is urged outward by a spring (not shown) within the alarm detector means 34 once the movement restricting object, i.e. the window sash, is removed. The alert continues to sound until either the screen alarm means 10 is disarmed using the switch means 46 or the battery 44 loses its charge disabling the alarm circuit. The alert may be audible and can be patterned to be either a high pitch piercing sound or a voice. In addition, other alert methods can be used such as a blinking or strobing light which is activated once the plunger 36 is extended and the alarm circuit is completed.

Although the alarm box 28 is shown mounted in the upper left region of the first screen panel 12, it is possible to mount the alarm box 28 in the overlapping region of the two screen panels 12, 14 (in the upper right region of screen panel 12) or on the second screen panel 14 in its upper right region. This last position may inhibit the use of the screen alarm means 10 in a narrow window opening which opening would be just slightly larger than the length of one screen panel.

Further, it is possible to invert the screen alarm means 10 and have the plunger 36 contact the window sill rather than the bottom of the lower window sash. In this case, the lifting of the window sash or the removal of the screen alarm means 10 would cause the plunger to move outward from the first screen panel 12 triggering the alarm when the alarm circuit is armed. It should be understood that the plunger 36 is depressible so that the top of the plunger extends no farther outward than the top (or bottom) of the frame of the first screen panel 12. As can be seen by reference to FIG. 3, the alarm detector means 34 extends through the hollow inside of the frame of the first screen panel 12 without interfering with the retainer 26 and the channel 24.

The invention as described-comprises a first embodiment of the present invention in which both the first and second screen panels 12, 14 do not carry any wires or conductors associated with the alarm. Only the mounting in an upper corner of one of the alarm screens of the alarm box 28 and detector means 34 creates the alarm function for the screen alarm means 10. In this embodiment, it may be possible to push closed the screen alarm means 10 by moving the second screen panel 14 sideways to gain access to the structure without removing the screen alarm means 10 or raising the window. Thus, a second embodiment of the invention is described below.

Figure 5:
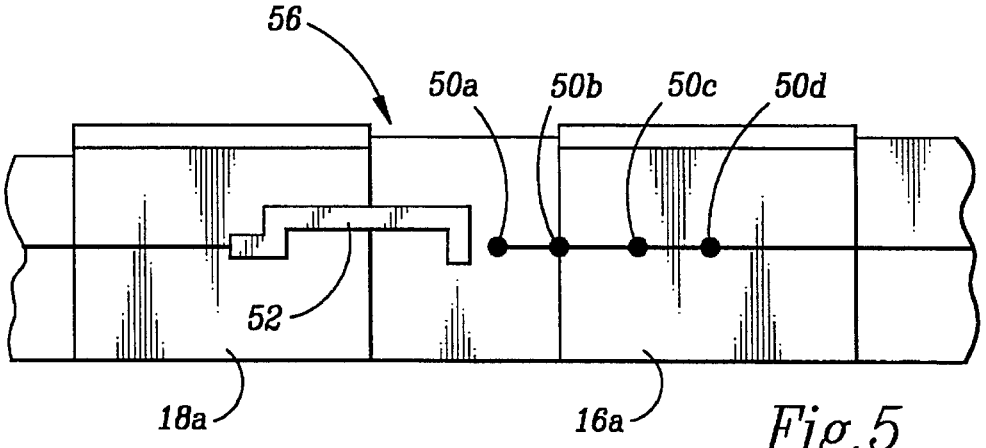
FIG. 5 is an enlarged view of the upper central region of the screen alarm of the present invention of FIG. 4.

FIGS. 4 and 5 illustrate a second alarm triggering means which can be used in conjunction with the first alarm triggering means described above. In order to protect both the first and second screen panels 13, 15, the second alarm triggering means would be activated when the screen panel 15 is slidably moved along the facing side of the first screen panel 13 to a pre-determined point causing the activation of the alarm circuit. The second triggering means comprises a strip conductor 52 which is positioned along the side of the screen panel 13 facing screen panel 15. On this facing side of screen panel 15, contacts 50*a–d* are positioned at pre-selected distances. Screen panels 13, 15 are slidably moved against each other causing strip conductor 52 and one of the contacts 50*a–d* to contact and connect in parallel to the alarm detector connection points of the alarm circuit. When the strip conductor 52 located on screen panel 13 is slidably positioned over one of the contacts 50*a–d* located on screen panel 15, the alarm is armed. Once the screen panels 13 or 15 are moved from any of the pre-selected positions, the circuit is broken and the alarm will sound.

Second alarm triggering means 56 is connected to the alarm circuit of alarm box 28. Triggering means 56 can be directly connected to alarm box 28 by connecting one end of conductive strip 52 to alarm box 28. Contacts 50*a–*50*d* are connected to a closed loop circuit so that when they contact conductive strip 52 the circuit is complete. When the screen alarm means 10 is reset, the second triggering means 56 is activated. Once activated, if the screen panels 13 or 15 are moved, the contacts 50 will no longer contact conductive strip 52 breaking the circuit and sounding the alert. The alert will continue to sound until the screen alarm means 10 is reset.

Triggering means 56 can be used in conjunction with interwoven wire circuit 48 or electrically conductive coating circuit 54. As illustrated in FIG. 4, wire 48 is interwoven through screen mesh 20 with one end being connected to alarm box 28 and the other end being connected to conductive strip 52. A wire may also be woven through screen mesh 22 (although not shown in FIG. 4) forming a closed loop circuit which is connected to the end of contacts 50*a–d*. If screen mesh 20 or 22 is cut then wire 48 will also be cut breaking the circuit and causing the alert to sound.

FIG. 4 also illustrates using an electrically conductive coating 54 which is applied to screen mesh 22. The conductive coating 54 is applied to the screen mesh 22 in a pre-determined and non-overlapping pattern, such that a closed loop circuit is formed on mesh 22. In a similar manner conductive coating may be applied to screen mesh 20, although not shown in FIG. 4. The closed circuit loop on screen mesh 20 is attached to the conductive strip 52. The closed circuit loop on screen mesh 22 is attached to contacts 50*a–d*. If screen mesh 20 or 22 is cut then either closed loop circuits will be broken and the alert will sound as described above.

The first embodiment of the screen alarm means 10 is dimensioned to fit within window openings varying in width from approximately 22 inches to approximately 37 inches and to provide a ventilation opening of approximately 13 inches in height from the window sill. The second embodiment of the screen alarm means 10 is dimensioned to fit within window openings varying in width from approximately 10 inches to approximately 22 inches and to provide a ventilation opening encompassing the entire height of the window which ranges approximately from 36 inches to 50 inches. While these dimensions are presently preferred, other dimension of either greater or narrower width, or greater or lesser height are acceptable, provided that the elements are contained on and within the screen alarm means 10.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A portable expandable intrusion detection screen for use with an electronic alarm means comprising first and second screen panels having bracket means which are affixed to both screen panels so as to form adjacent parallel channels in which said first screen panel is slidably movable in parallel relation to the second screen panel and said second screen panel is slidably movable in parallel relation to the first screen panel so that each screen panel can slidably move in relation to the other to be expandable to fit within different sized window openings, screen mesh mechanically mounted and retained within an internal peripheral channel in the frame of each screen panel, an alarm means permanently affixed to a mounting bracket attachable to one of said screen panels and having an intrusion detector means extending outward through the frame of the screen panel to which the alarm means is mounted for detecting the separation of the screen panel from any part of the window against which the screen panel onto which said alarm means is attached is placed when positioned in a window opening.

2. A portable expandable intrusion detection screen in accordance with claim 1, said alarm means being armed and disarmed by a switch means operable by use of a key means.

3. A portable expandable intrusion detection screen in accordance with claim 2, said key means being a pointed implement.

4. A portable expandable intrusion detection screen in accordance with claim 1, said intrusion detector means being a plunger-type actuating means for detecting the separation of the screen panel from the window part against which the actuating means is placed.

5. A portable expandable intrusion detection screen in accordance with claim 1, said intrusion detector means being mounted through said frame of the screen panel at a pre-determined distance from said alarm means.

6. A portable expandable intrusion detection screen in accordance with claim 1, wherein said mounting bracket is attached to one of said screen panels by flanges on adjoining sides of said mounting bracket extending into said internal peripheral channel in the frame of said screen panel and retained therein.

7. A portable expandable intrusion detection screen in accordance with claim 1, wherein said electronic alarm means further comprises a second intrusion detector means having plural contacts through the frame of the screen panel to which the alarm means is mounted on the side facing the other screen panel for contact with a conductor strip means mounted to the adjacent facing side of the frame of the other screen panel for detecting the inward sliding of one screen panel against the other screen panel more than a pre-determined distance.

8. A portable expandable intrusion detection screen in accordance with claim 7, wherein said pre-determined distance is in the range of 1 inch to 6 inches.

9. An expandable intrusion detection screen in accordance with claim 7, wherein said plural contacts are connected to a first closed loop circuit mounted on said screen mesh of said first screen panel and said conductor strip is connected to a second closed loop circuit mounted on the screen mesh of said second screen panel.

10. An expandable intrusion detection screen in accordance with claim 9, wherein said first and second closed loop circuits comprise wire interwoven into said screen mesh.

11. An expandable intrusion detection screen in accordance with claim 9, wherein said first and second closed loop circuits comprise an electrically conductive coating placed onto said mesh in a pattern which will form said closed loop circuits.

12. A portable intrusion detection screen for use with an electronic alarm means comprising a screen panel having screen mesh mechanically mounted and retained within an internal peripheral channel in the frame of said screen panel, an alarm means permanently affixed to a mounting bracket attachable to said screen panel and having an intrusion detector means extending outward through the frame of the screen panel to which the alarm means is mounted for detecting the separation of the screen panel from any part of the window against which the screen panel onto which said alarm means is attached is placed when positioned in a window opening.

13. A portable intrusion detection screen in accordance with claim 12, said alarm means being armed and disarmed by a switch means operable by use of a key means.

14. A portable intrusion detection screen in accordance with claim 13, said key means being a pointed implement.

15. A portable intrusion detection screen in accordance with claim 12, said intrusion detector means being a plunger-type actuating means for detecting the separation of the screen panel from the window part against which the actuating means is placed.

16. A portable intrusion detection screen in accordance with claim 12, said intrusion detector means being mounted through said frame of the screen panel at a pre-determined distance from said alarm means.

17. A portable intrusion detection screen in accordance with claim 12, wherein said electronic alarm means further comprises a second intrusion detector means comprising a closed looped circuit mounted on said screen mesh of said screen panel said alarm means being activated when said closed looped circuit is broken.

18. A portable intrusion detection screen in accordance with claim 17, wherein said closed looped circuit comprises a wire interwoven into said screen mesh.

19. A portable intrusion detection screen in accordance with claim 17, wherein said closed looped circuit comprises an electrically conductive coating placed onto said mesh in a pattern which will form said closed looped circuit.

* * * * *